United States Patent [19]

Regan

[11] 4,053,957

[45] Oct. 18, 1977

[54] MULTI-LAYERED MATTRESS

[76] Inventor: John J. Regan, 2316 N. Harlem Ave., Elmwood Park, Ill. 60635

[21] Appl. No.: 691,464

[22] Filed: June 1, 1976

[51] Int. Cl.[2] ..... A47C 23/00

[52] U.S. Cl. ..... 5/355; 5/361 B

[58] Field of Search ..... 5/345 R, 355, 361, 361 B

[56] References Cited

U.S. PATENT DOCUMENTS

| | | | |
|---|---|---|---|
| 3,419,920 | 1/1969 | Maddux et al. | 5/345 |
| 3,553,748 | 1/1971 | Ross | 5/345 |
| 3,828,378 | 8/1974 | Flam | 5/91 |
| 3,846,857 | 11/1974 | Weinstock | 5/345 |
| 3,885,258 | 5/1975 | Regan | 5/361 |

*Primary Examiner*—Paul R. Gilliam
*Assistant Examiner*—Andrew M. Calvert
*Attorney, Agent, or Firm*—Wegner, Stellman, McCord, Wiles & Wood

[57] ABSTRACT

A multi-layered mattress for straightening a reclining body including a lower layer which has a support engaging bottom surface and a generally planar top surface. An upper layer which has a bottom surface engaging the top surface of the lower layer and a top, body supporting surface. The resiliency of the material in the upper layer is greater than that of the lower layer. First and second ribs of less resiliency than the upper layer extend transversely across and upwardly from the upper surface of the lower layer into complementary recesses in the bottom surface of the upper layer. The first and second ribs are positioned to support the shoulders and the buttocks of one lying on the mattress.

4 Claims, 2 Drawing Figures

MULTI-LAYERED MATTRESS

CROSS-REFERENCE

This application is a substitution for Ser. No. 577,687, filed May 15, 1975, now abandoned, and is an improvement of U.S. Pat. No. 3,885,258, issued May 27, 1975.

BACKGROUND OF THE INVENTION

It is a widely accepted theory that dreams are related to bodily irritations. My U.S. Pat. No. 3,885,258 discloses a multi-layered mattress which minimizes bodily irritations and supports the user's body in a level condition by providing maximum support in areas of greatest weight. It is diametrically opposite to the approach of the prior art.

Schenker U.S. Pat. No. 2,469,084 is typical of prior art approaches which include a rigid member or the like shaped in accordance with the individual's anatomical configuration for therapeutic uses. However, this body resting appliance lacks the maximum support in the areas of the greatest weight because its rigid member follows the natural contour of the body. Furthermore, a mattress like Schenker, which is comprised of members that follow the anatomical configuration of a human body, is difficult to manufacture.

Other prior art mattresses, instead of minimizing bodily irritations, often increase them by creating a "hammocking" of the body. Shecter et al U.S. Pat. No. 3,047,888 demonstrates this "hammocking" condition in FIG. 3.

The multi-layered mattress of this application is made without members that conform to the anatomical configuration of a human body. This makes it easier to manufacture. In addition, the mattress avoids the "hammocking" of Shecter et al by providing two areas of maximum support beneath the shoulders and buttocks of one lying on the mattress, which are the two greatest points of depression.

SUMMARY OF THE INVENTION

It is a primary object of the present invention to provide a multi-layered foam rubber mattress which avoids "hammocking" of the user's body.

It is another object of the present invention to provide a multi-layered foam rubber mattress that has maximum support in the areas of greatest weight to minimize bodily irritations during sleep from an unlevel condition of the user's body on the mattress.

A further object of the present invention is to provide a multi-layered foam rubber mattress which avoids "hammocking" and reduces bodily irritations without members conforming to anatomical configuration of a human body which are difficult to manufacture.

In accordance with the present invention, a multi-layered mattress includes a lower layer which has a support engaging surface and a generally planar top surface. An upper layer has a bottom surface engaging the top surface of the lower layer and a top, body supporting surface. The resiliency of the material of the upper layer is greater than that of the lower layer. A first rib of less resiliency than the upper layer extends transversely across and upwardly from the planar top surface of the lower layer into a complementary recess in the bottom surface of the upper layer. A second rib, again of less resiliency than the upper layer, is spaced longitudinally on the mattress from the first rib and extends transversely across and upwardly from the top surface of the lower layer into a complementary recess on the bottom surface of the upper layer. The first and second ribs are positioned to support the shoulders and buttocks of one lying on the mattress.

One feature of the invention is the provision of longitudinally spaced apart ribs when permits one to be depressed without affecting the other.

Another feature of the invention is that the lower layer and ribs form a unitary construction for easy manufacturing.

Still another feature of the invention is that the ribs have a rectangular cross section with a flat planar upper surface of a width sufficient to provide maximum support to the shoulders and buttocks of many different users.

Further features and advantages of the invention will readily be apparent from the following specification taken in connection with the accompanying drawings.

DESCRIPTION OF THE PREFERRED EMBODIMENT

Figure 1:
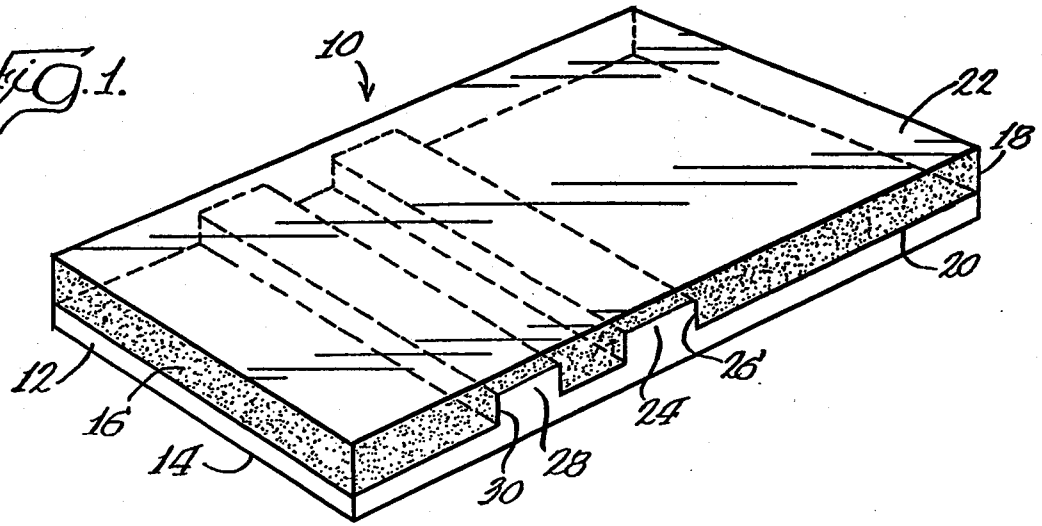
FIG. 1 is a perspective view of the mattress according to one embodiment of the present invention.

An improved multi-layered mattress for supporting a user's body in a straight condition is shown in FIG. 1 wherein a two-layered mattress indicated generally at 10 includes a lower layer 12 of foam material or the like which has a support engaging bottom surface 14 and a generally planar top surface 16. An upper layer 18, also of suitable foam material, has a bottom surface 20 engaging the top surface 16 of the lower layer 12 and a top 22, the body supporting surface. The resiliency of the upper layer 18 is greater than that of the lower layer 12. The upper surface 16 of the lower layer 12 includes a rectilinear rib 24 of less resiliency than the upper layer 18. The rib extends transversely across and upwardly from the planar top surface 16 of the lower layer 12 into a complementary recess 26 in the bottom surface 20 of the upper layer 18. The rib 24 is located beneath the position in which the user's buttocks rest upon the mattress 10. The rib 24 has a sufficient rectangular cross section for providing maximum support to the buttock area of one lying on the mattress.

A second rib 28 of less resiliency than the upper layer 18 is spaced longitudinally on the mattress 10 from the first rib 24. The rib 28 extends transversely across and upwardly from the planar top surface 16 of the lower layer 12 into a complementary recess 30 in the bottom surface 20 of the upper layer 18. The second rib is positioned to provide maximum support to the shoulders of one lying on the mattress 10, and has a rectangular cross section which is sufficient to support the shoulders of most users.

The ribs 28 and 24 provide maximum support to the shoulders and buttocks, respectively, which are the areas of the greatest weight of the user's body. Therefore, this construction of ribs with rectangular cross sections avoids "hammocking" of the user's body on the mattress 10. Moreover, the ribs act independently of one another to minimize the bodily irritations which occur when the user's body is unlevel on the mattress.

The top layer 18 may be made of foam material of a particular firmness to match the user's preference, but in all cases the upper layer 18 has a resiliency greater than the rectangular rib members 24 and 28 and lower layer 12. Preferably, the rectangular ribs 24 and 28 and the lower layer 12 are made from a one piece mold, as a unit.

Figure 2:
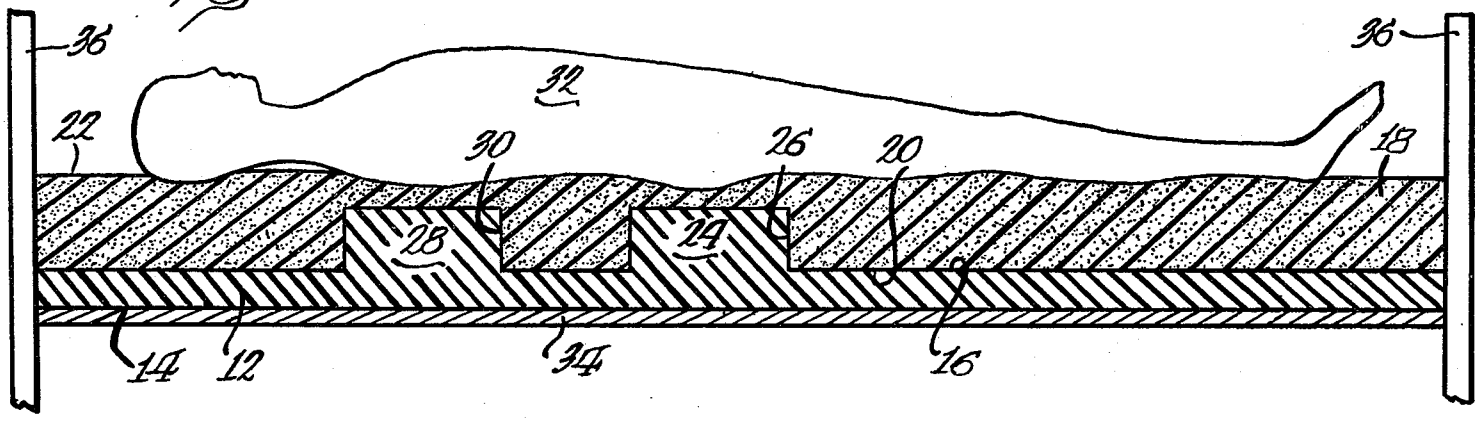
FIG. 2 is a longitudinal section thereof with a human body lying thereon.

Turning now to FIG. 2, there is illustrated a human body 32 in a reclining position on the two-layered mattress 10. The two-layered mattress 10 is supported on a flat sheet 34 which is connected between a pair of supporting end boards 36. The ribs 24 and 28, which form a unitary construction with the lower layer 12, are seen to extend upwardly in the area in which the human body presses downwardly upon the mattress with the greatest weight. Therefore, the ribs 24 and 28, which extend upwardly from the lower layer to form flat planar surfaces beneath the user's buttocks and shoulders, respectively, resist depression of the mattress by the user's body in these areas (which would result in "hammocking" of the body) and, thus, tend to straighten out the human body to provide much greater comfort for sleeping.

The improved multi-layered mattress is easier to manufacture than the mattress in my U.S. Pat. No. 3,885,258 which utilizes inverted contour members. However, both propose a concept which is diametrically opposite to the approach of the prior art for straightening the user's body in slumber to minimize bodily irritations.

I claim:

1. In a multi-layered mattress, including, a lower layer having a support engaging bottom surface and a generally planar top surface, and an upper layer having a bottom surface engaging the top surface of the lower layer and a top, body supporting surface, the resiliency of the material of the upper layer being greater than that of the lower layer, the improvement which comprises:

a first rib of less resiliency than the upper layer extending transversely across and upwardly from the planar top surface of the lower layer into a complementary recess in the bottom surface of the upper layer; and a second rib of less resiliency than the upper layer spaced longitudinally on the mattress from the first rib and extending transversely across and upwardly from the top planar surface of the lower layer into a complementary recess in the bottom surface of the upper layer, said first and second ribs being spaced apart longitudinally of the mattress and positioned to support the shoulders and buttocks of one lying on the mattress, the lesser resilience of the ribs complementing the greater resilience of the upper layer to support the body lying on the mattress in a straight condition.

2. The multi-layered mattress of claim 1 in which the lower layer and ribs are of a unitary construction.

3. The multi-layered mattress of claim 1 in which said first and second ribs have a rectangular cross section.

4. A multi-layered mattress, comprising:

a lower layer of resilient foam material having a support engaging bottom surface, a generally planar top surface and a pair of rectangular cross section ribs being spaced apart longitudinally of one another on said top surface and extending transversely thereacross and upwardly therefrom; and an upper layer of resilient foam material having a bottom surface engaging the top surface of the lower layer including a pair of complementary recesses, each receiving one of said ribs therein, the resiliency of the foam material of the lower layer being less that that of the upper layer, said ribs and associated complementary recesses being positioned beneath the shoulder and buttock areas of one lying on the mattress for supporting the same, the lesser resilience of the lower layer and ribs complementing the greater resilience of the upper layer so that the user's body is substantially straight without "hammocking" of the body, to minimize bodily irritations during slumber.

* * * * *